US006592497B2

(12) United States Patent
Greenheck

(10) Patent No.: US 6,592,497 B2
(45) Date of Patent: Jul. 15, 2003

(54) LEG BARBELL

(76) Inventor: Jeffrey C. Greenheck, P.O. Box 113, Lone Rock, WI (US) 53556

( * ) Notice: Subject to any disclaimer, the term of this patent is extended or adjusted under 35 U.S.C. 154(b) by 0 days.

(21) Appl. No.: 09/793,208

(22) Filed: Feb. 26, 2001

(65) Prior Publication Data

US 2002/0119872 A1 Aug. 29, 2002

(51) Int. Cl.[7] ..... A63B 21/06

(52) U.S. Cl. ..... 482/93; 482/46; 482/79; 482/80

(58) Field of Search ..... 482/46, 50, 145, 482/62, 79, 80, 92–97, 908, 133–138, 98–104, 139, 142

(56) References Cited

U.S. PATENT DOCUMENTS

| | | | | |
|---|---|---|---|---|
| 757,983 | A | 4/1904 | Vaile | |
| 2,114,790 | A | 4/1938 | Venables | |
| 2,214,052 | A | 9/1940 | Good | |
| 2,952,459 | A | 9/1960 | Moffitt | |
| 3,343,836 | A | 9/1967 | James, Jr. | |
| 3,850,430 | A | 11/1974 | Hamilton | |
| 4,509,746 | A | 4/1985 | Mask | |
| 4,679,788 | A | 7/1987 | Adler | |
| 4,807,873 | A | 2/1989 | Naquin | |
| 4,896,879 | A | 1/1990 | Klatwitter | |
| 4,911,434 | A | 3/1990 | Herring | |
| 5,011,140 | A | 4/1991 | Adessi | |
| 5,031,905 | A * | 7/1991 | Walsh | 272/130 |
| 5,169,364 | A | 12/1992 | Donaldson | |
| 5,267,927 | A | 12/1993 | Cantanzano et al. | |
| 5,356,359 | A | 10/1994 | Simmons | |
| 5,562,579 | A | 10/1996 | Sheikowitz | |
| 5,897,473 | A | 4/1999 | Koenig | |
| 5,935,047 | A | 8/1999 | Cawley | |
| 6,090,021 | A | 7/2000 | Flowers | |

OTHER PUBLICATIONS bigfitness.com, website printouts (9 pp) Powtucket, R.I., 2000.

Performbetter.com, website printout (1 p), MF Athletic, Inc. Cranston, RI, 2000.

Quantumfitness.com, website printout (2 pp), Stafford, TX, 2000–2001.

Nugym.com, website printout (2 pp).

"APEC Inc. Introduces the TIB Exerciser," ©1999, Apec; www.apecsports.com, website printout (3 pp).

* cited by examiner

*Primary Examiner*—Nicholas D. Lucchesi
*Assistant Examiner*—Lori Baker Amerson
(74) *Attorney, Agent, or Firm*—Lathrop & Clark LLP

(57) ABSTRACT

A leg column extends between a user's legs, and a connected foot column extends front to back between the user's feet. Front and rear foot rods beneath the foot column bear against the soles of a user's feet. Cushioned front, rear and upper weight rods are connected to the leg and foot columns to bear against the foot above the user's toes, the user's feet above the heels and the lower legs at the shins, respectively. Barbell weights are removably connected to the weight rods. The relationships of the foot rods and weight rods are adjustable to suit a particular user. The leg barbell is completely free from connection to any fixed structure and, although secured to the user's legs and feet for a variety of exercises, is readily disengaged. The weight rods and foot rods may be connected with telescoping mounting members or perforated barstock to facilitate convenient adjustment.

16 Claims, 6 Drawing Sheets

LEG BARBELL

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to exercise devices in general, and to an apparatus which may be used with the lower limbs in particular. There are many human activities which require a certain level of strength and endurance either to perform well, or to perform at all. Athletic competition, industrial tasks, police, fire, and rescue activities, and military preparedness are some of the activities which impose demanding requirements on those who participate in them.

The physiology of the human body is such that continued repetition of demanding chores will in many cases result in a gradual strengthening of those muscles called into use, and a gradual buildup of the endurance necessary to perform that chore well. Nevertheless, in some cases the threshold strength requirements needed to even attempt a particular activity cannot be met by a particular person. Or, the actual activity may be costly or difficult to participate in, making the provision of some substitute training activity desirable for reasons of convenience or cost. Moreover, the actual activity may make only transient or momentary demands requiring full strength, making it difficult to build strength in those areas of the body where it is required.

For these reasons and others, regimens of physical training have been developed to assist the trainee in obtaining adequate levels of strength in precisely those muscle groups where it is required. It has been observed that simple exercises, repeated with regularity, and with increasing levels of difficulty, can effectively and rapidly build strength and endurance.

There are many activities which require strength in the legs, calves, lower back, and abdomen. Strength in these regions could be obtained by imposing loads on a trainee's feet, calves, or legs. However, difficulties exist in attaching in a convenient fashion weights to a trainee's feet which are not present with barbells designed to strengthen a trainee's arms and upper body. While conventional hand barbells can be securely gripped by the trainee's hands, the feet do not have this capability.

A number of weight training machines have been developed capable of imposing loads on a trainee's legs. Typically, these machines have a weight supporting structure which is hinged to a table or bench in such a fashion that a trainee's legs may extend beneath the weights for lifting. However, not only do these machines require the added expense of a specialized bench, they often result in the bench carrying a portion of the weight in certain orientations. Moreover, these fixed weights impose restrictions on the trainee's body movement which can limit the number and variety of exercises that can be performed.

A weight training apparatus which could be freely operated by a trainee would offer a number of advantages in terms of ease-of-use, variety, and effectiveness in muscle development.

SUMMARY OF THE INVENTION

The leg barbell of this invention has a frame for mounting weights to a trainee's feet and legs without any connection to the floor or any fixed apparatus. The leg barbell has an upwardly extending leg column to which a front to back foot column is connected. The leg column is centrally positioned such that the user may place one foot on either side of the leg column. A front foot rod and a rear foot rod are positioned beneath the foot column and extend perpendicular to the foot column and the leg column. The foot rods bear against the soles of the user's feet. A cushioned front weight rod is connected to the foot column above the front foot rod and a cushioned rear weight rod is connected to the foot column rearward and above the two foot rods. The front weight rod engages against the user's toes, while the rear weight rod engages the user's feet above the heels. An upper weight rod, also cushioned, engages the user's lower leg at the shin. The weights are preferably retained with a locking collar on the weight rods. The user flexes the muscles of the feet and lower legs which engage the barbell and retain it in position. Conventional barbell weights may thus be mounted at various positions on the barbell. The relationships of the foot rods and the weight rods are adjustable to fit a particular user. Although the barbell is secured to the user's legs and feet for a variety of exercises, it is readily disengaged from the user without the need to adjust any straps or fasteners. The weight rods and foot rods may be connected with telescoping mounting members or perforated barstock to facilitate convenient adjustment.

It is an object of the present invention to provide a weight training device which can impose selected levels of weight loads at the level of a trainee's feet.

It is another object of the present invention to provide a leg barbell which is readily adjustable to suit a wide variety of users.

It is a further object of the present invention to provide a leg barbell which can be used in a variety of positions to complement varying exercises.

It is also an object of the present invention to provide a weight training device which can impose weight loads on a user's lower legs throughout a range of motion.

Further objects, features and advantages of the invention will be apparent from the following detailed description when taken in conjunction with the accompanying drawings.

DESCRIPTION OF THE PREFERRED EMBODIMENTS

Figure 1:
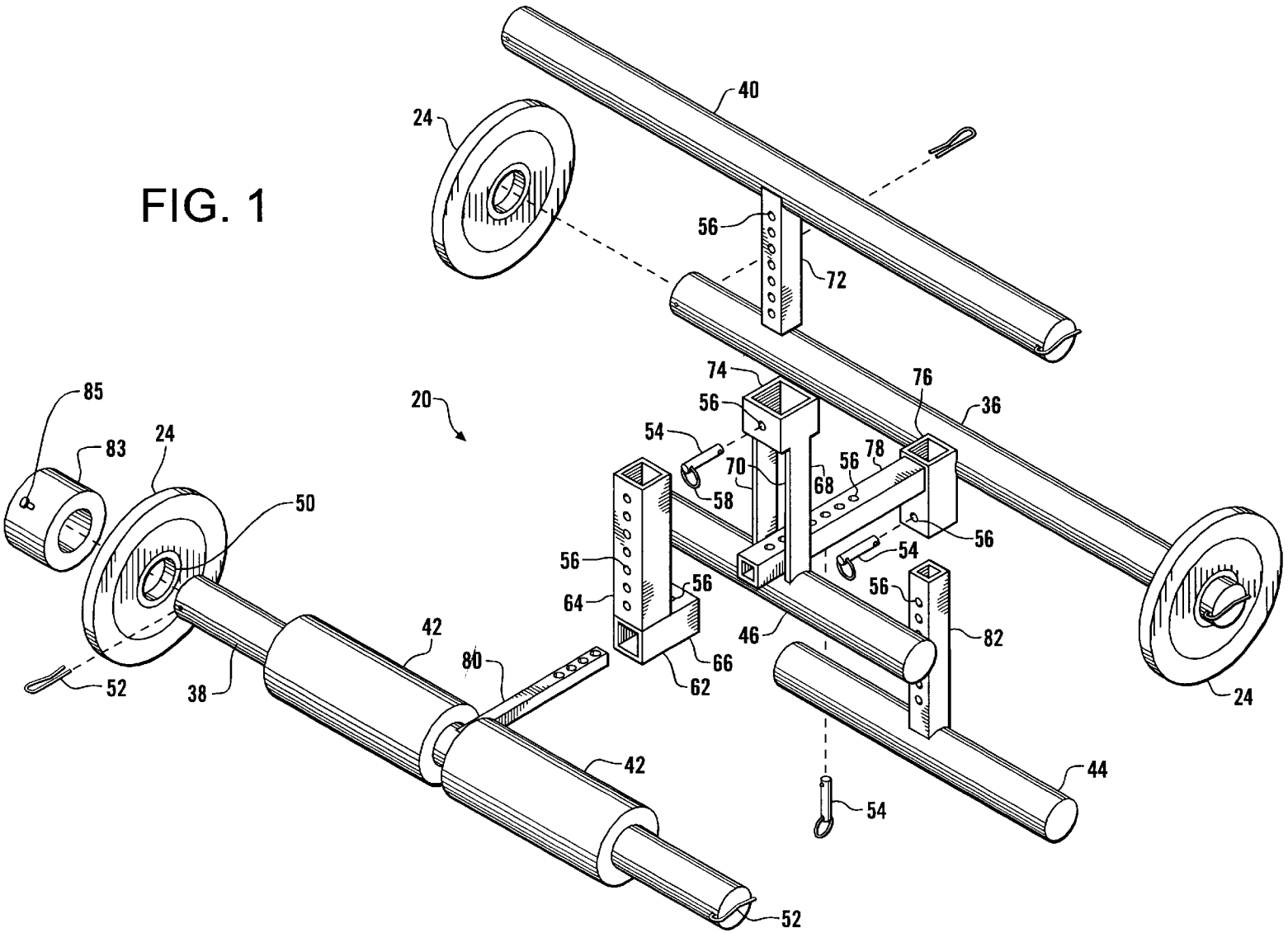
FIG. 1 is an exploded isometric view of the leg barbell of this invention.
Figure 2:
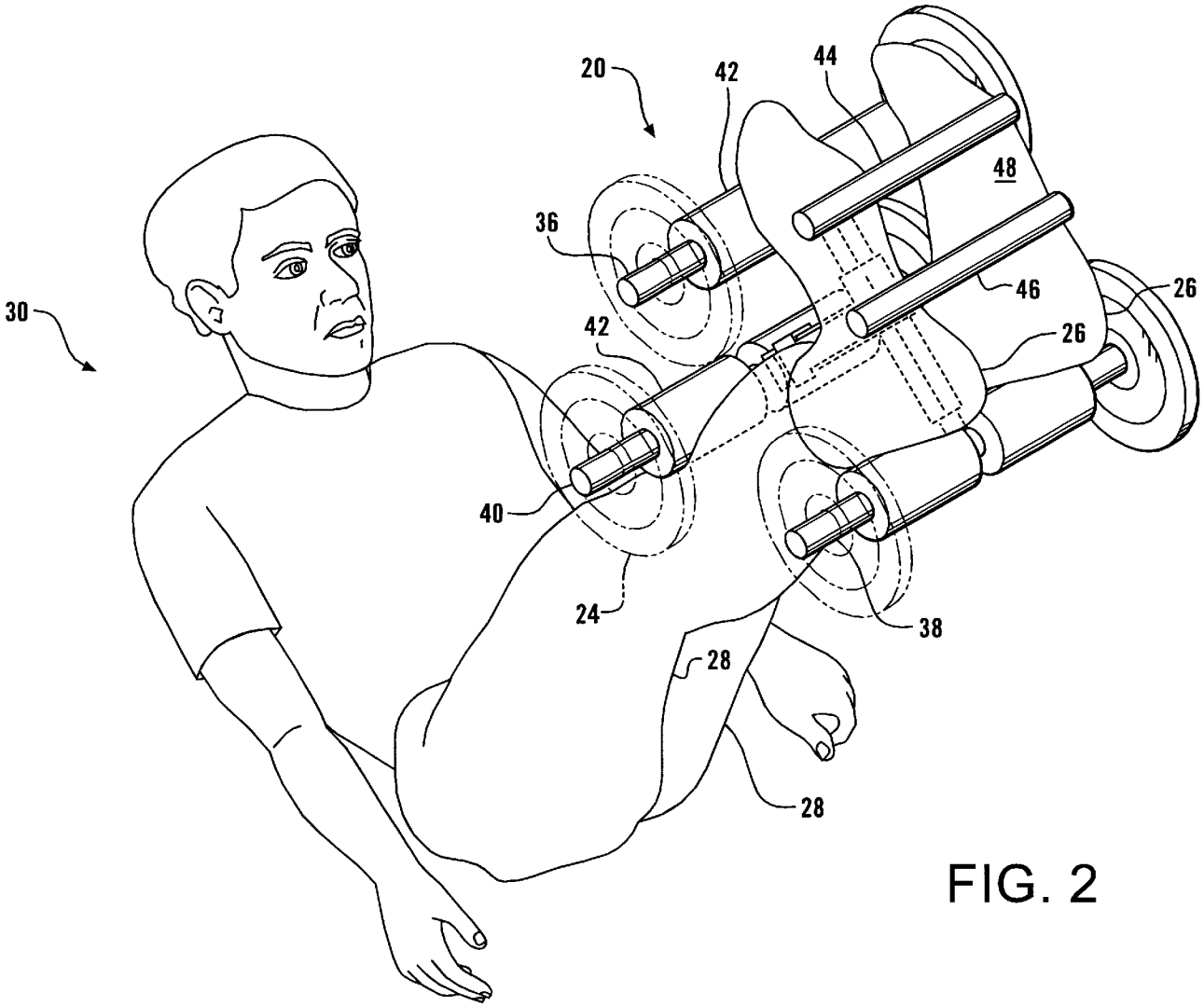
FIG. 2 is a perspective view of the leg barbell of FIG. 1 in use.
Figure 3:
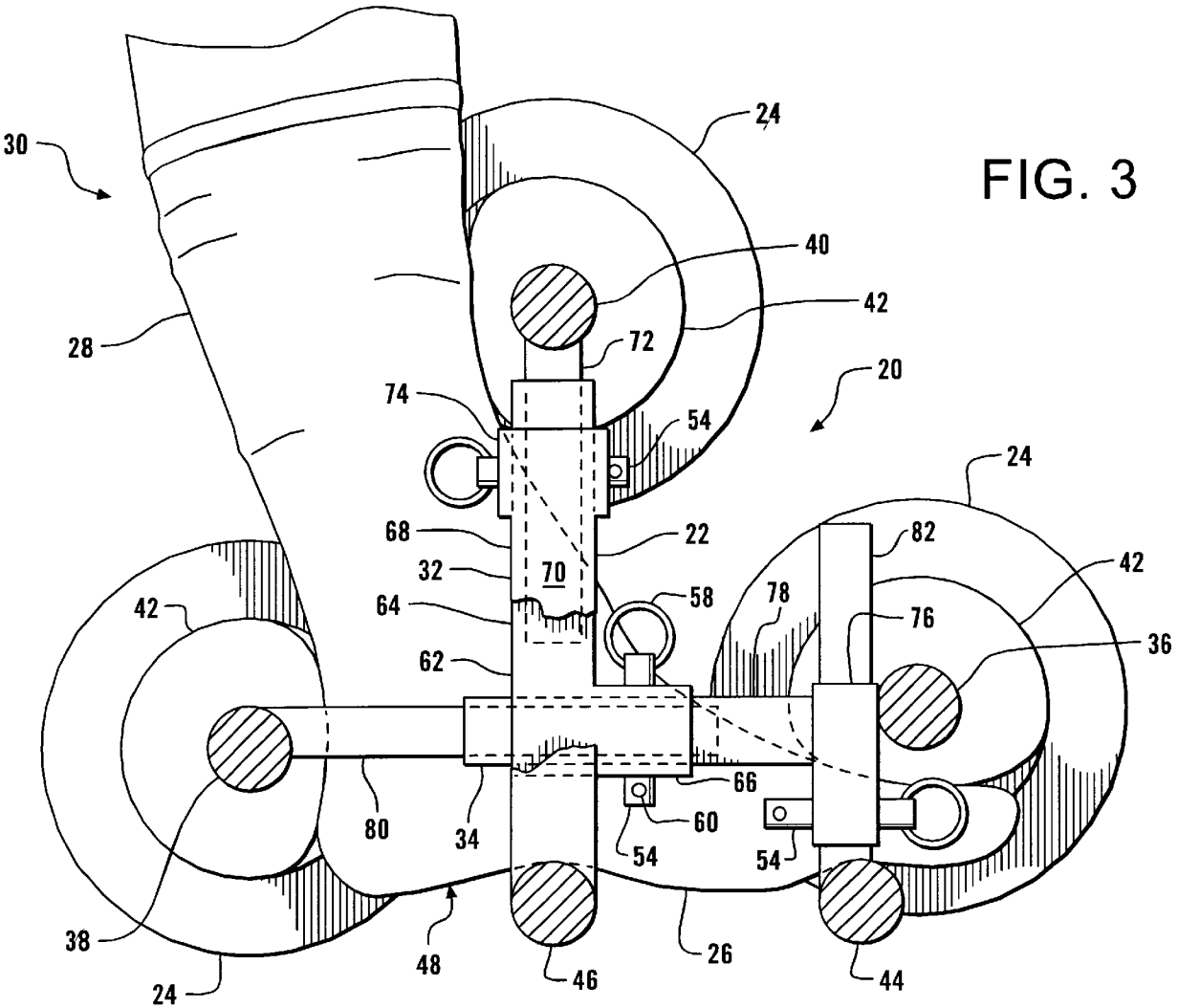
FIG. 3 is a side elevational view of the leg barbell of FIG. 2, partially broken away in section.

Referring more particularly to FIGS. 1–7 wherein like numbers refer to similar parts, a leg barbell 20 is shown in FIGS. 1–3. The leg barbell 20 has a frame 22 to which weight rods are fixed and on which conventional disk shaped weights 24 are removably attached. Unlike a conventional hand barbell or dumbbell, which can be readily grasped by any user with sufficient strength, the leg barbell 20 is configured for mounting on the feet 26 and legs 28 of a particular user 30. As shown in FIG. 2, the leg barbell 20 mounts to the feet and legs of the user 30 without straps, belts, or fasteners. Hence, engaging the barbell 20 to begin exercises, and disengaging from the barbell is a simple and rapid process. To facilitate this mounting of the barbell 20 to the user 30, the leg barbell 20 is preferably adjusted in its dimensions to fit the measurements of a particular user 30.

A frame 22 of the leg barbell 20 has a generally inverted T-shape, comprised of a generally upwardly extending leg column 32 which is positioned between the legs of the user 30, and a front to back extending foot column 34 which extends perpendicularly to the leg column between the user's feet. The weights 24 are mounted to one or more of a front weight rod 36, a rear weight rod 38, and an upper weight rod 40. The front weight rod 36 may also be referred to herein as a front rod 36, the rear weight rod 38 as the rear rod 38, and the upper weight rod 40 as the upper rod 40. The leg barbell 20 may thus be loaded with increasing loads, generally to about fifty pounds, for weight training as needed. However, with increased strength, loads could be greater still. As best shown in FIG. 3, each weight rod 36, 38, 40 is cushioned by a pair of resilient foam covers 42 which serve as cushions where the user engages the stiff rods of the frame 2% The covers 42 are cylindrical tubes which are engaged with the cylindrical weight rods in a friction fit. The covers 42 cushion the engagement between the weight rods and the user's feet and legs. The weight rods are positioned to retain the leg barbell 20 on the user throughout a range of exercise motions.

In addition to the weight rods, a front foot rod 44 and a rear foot rod 46 engage the undersides or soles 48 of the user's feet. The front foot rod 44 engages the feet 26 just rearward of the toes, while the rear foot rod 46 engages the feet frontwardly of the heels. When the leg barbell 20 is mounted to a user, the front weight rod 36 engages the user's feet just rearward of the toes. The rear weight rod 38 engages the ankles above the heels, and the upper weight rod 40 engages the shins above the ankles. The weight rods and the foot rods may be about one inch in diameter.

As shown in FIG. 1, the leg barbell 20 is symmetrical about an axis running horizontally between the feet, thereby maintaining an even application of load to the user's feet and legs. The removable weights 24 have central openings 50 sized to receive the ends of the weight rods therethrough. Once in position, the weights 24 may be held in place by a cylindrical collar 83 having a set screw 85. The collars are adjustable along the length of the weight rod to accommodate multiple weights. The foam covers 42 along the inner portions of the weight rods prevent the inward displacement of the attached weights.

Cotter pins 52 or other fasteners may extend through holes in the ends of the weight rods as a restraint to prevent escape of the weights and the collars from the weight rods. For most exercises, weights should be placed in pairs, with one on each side of the user's feet. Alternatively, for a more centered disposition of weight, the weights may be placed on the frame on the inside of the foam pads.

To provide for the adjustment of the spacing between the weight rods and the foot rods, the frame 22 is fashioned from a number of repositionable segments permitting the convenient movement of the rods into an orientation which is desirable for a particular user, and the ready locking of the rods into this desired position once obtained.

As best shown in FIG. 1, the leg barbell 20 has a number of nesting and telescoping square tubular members which extend from the weight rods and the foot rods and which are locked into a desired position by restraint pins 54 which extend through aligned pin holes 56. Each restraint pin 54 has a pull ring 58 for ready access, and a spring loaded ball 60 for retention of the pin in its inserted configuration. The tubular members are preferably metal, such as stainless steel, cold rolled steel either blued or chrome-plated, aluminum, plastic, or other material.

The leg column 32 and the foot column 34 of the frame 22 are joined by a central connector 62 which has a vertical square tube segment 64 welded to a horizontal square tube segment 66. The central connector 62 may be formed of one inch square tubing, with a wall thickness of about 0.120 inches. The horizontal square tube segment 66 has a single pin bole, while the vertical square tube segment 64 has an array of pin holes, spaced above one another. The rear foot rod has an upwardly extending sleeve 68 with two sidewardly spaced steel straps 70 which straddle the vertical square tube segment 64 of the central connector 62. The upper weight rod 40 has an upper weight rod mounting member 72 which is tubular and which extends downwardly and which is received in telescoping relation within the vertical square tube segment 64 of the central connector 62. A square sleeve collar 74 at the top of the sleeve 68 above the straps 70 has a single pair of aligned pin holes. The collar is larger than the central connector 62 vertical square tube segment 64 such that the vertical square tube segment with the upper weight rod mounting member 72 may extend through the square sleeve collar 74 and the three elements pinned together with a single restraint pin 54, as shown in FIG. 3. The downwardly extending upper weight rod mounting member 72 also has a series of aligned pin holes, which allows the adjustment of the distance between the upper weight rod 40, the rear foot rod 46, and the horizontal square tube segment 66 of the connector 62. The upper weight rod mounting member 72, the central connector 62, and the sleeve 68 thus define the leg column 32.

The front weight rod 36 is affixed to a vertically extending square tubular collar 76 from which a square tubular mounting member 78 extends rearwardly and through the horizontal square tube segment 66 of the connector 62. A square tubular rear weight rod mounting member 80 extends frontwardly from the rear weight rod 38 and is received in telescoping relation within the front weight rod mounting member 78 and the horizontal square tube segment 66 of the connector 62. The front weight rod mounting member 78 and the rear weight rod mounting member 80 each have a series or horizontally spaced pin holes, selected pairs of which are aligned with the pair of pin holes on the horizontal square tube segment 66 of the connector 62 and are fixed in place with a single restraint pin 54.

As shown in FIG. 1, the front foot rod 44 has an upwardly extending square tubular mounting member 82 which extends through and is received within the collar 76 affixed to the front weight rod. The mounting member 82 has vertically spaced pairs of pin holes which may be selectably aligned with a pair of pin holes in the collar 76. The front foot rod 44 is held in place with respect to the front weight rod by a single restraint pin 54.

It will thus be seen that the leg barbell 20 may be adjusted to suit a wide range of user dimensions and fixed into an operating configuration by the insertion of the three restraint pins 54. In addition, the weights may be held on with alternative clamping arrangements, for example a spring lock collar having coils of spring wire with about a one inch inside diameter and two handles which allow the release of the collar. If the spring lock collars are used, the ends of the weight rods may be knurled to increase the diameter of the rod and serve to restrict the escape of the spring lock collars, serving the same purpose as the cotter pins illustrated above.

The user flexes the muscles of the feet and lower legs which engage the barbell and retain it in position. Contraction of the muscles is what puts the pressure on the front weight rod 36, the upper weight rod 40, and rear foot rod 46. Just as hand barbells are engaged by grasping with the hands, the leg barbell 20 is engaged by flexing the muscles, for example by pulling the toes up directed toward the knees.

Figure 7:
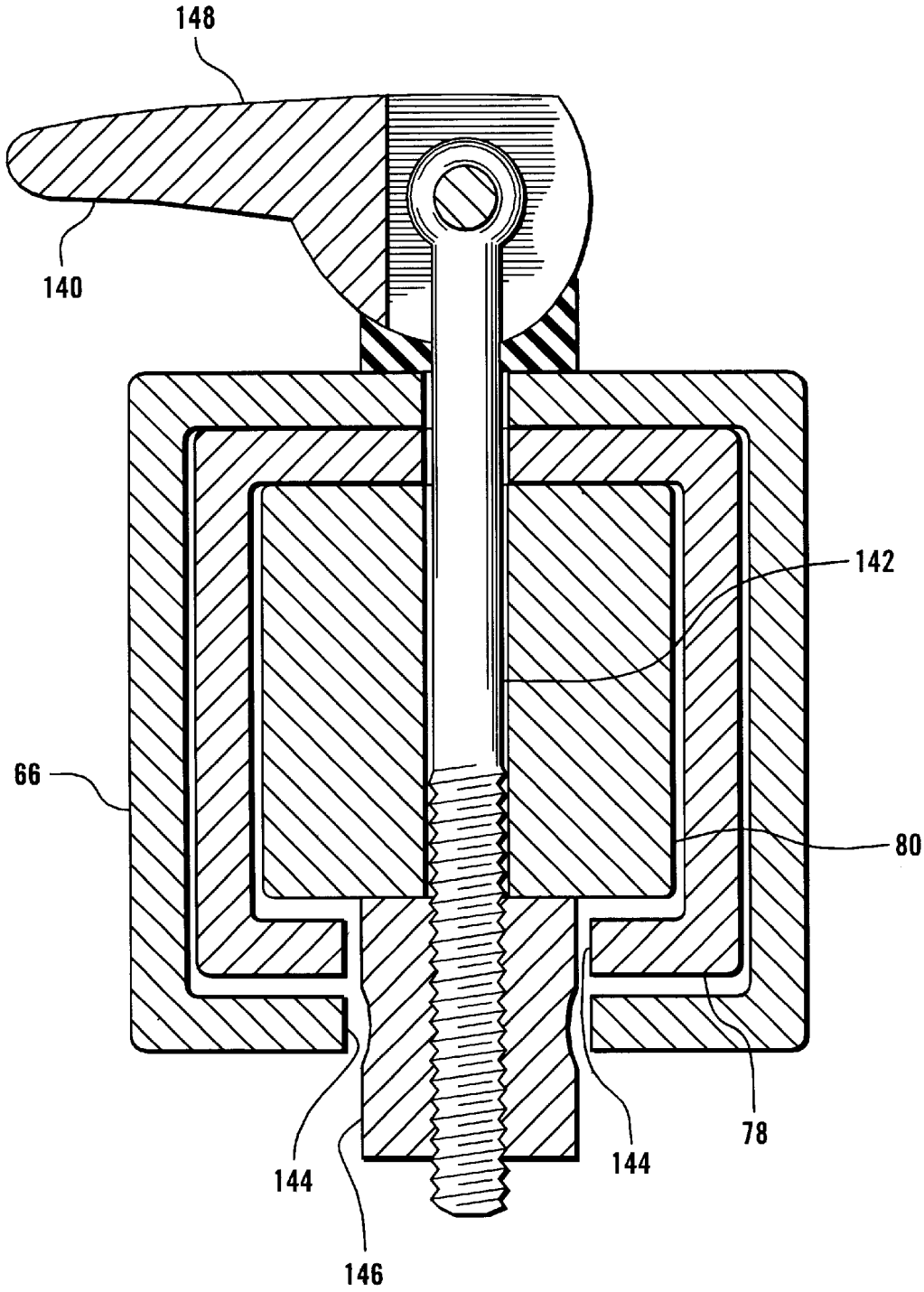
FIG. 7 is a cross-sectional view of an alternative fastening mechanism for the leg barbell of FIG. 1.

In place of the pins 54, the leg barbell 20 parts may alternatively be held together with a cain locking assembly 140, as shown in FIG. 7. The rear weight rod mounting member 80, the front weight rod mounting member 78, and the horizontal square tube 66 of the central connector 62, for example, are clamped together by a pin 142 that passes trough all three telescoped tubes. The lower portions of the two outer tubes have enlarged holes 144 to allow clearance for a nut 146 which engages against the innermost tube. Actuating the cain lever 148 clamps the three elements together. A cam locking assembly 140 may be substituted wherever the pins 54 are shown in FIG. 3. Another alternative fastener would be a weld-on spring loaded pop pin of the type which has a spring which drives the pin into engagement with the pin holes, yet which is retractable by the user for repositioning.

Figure 4:
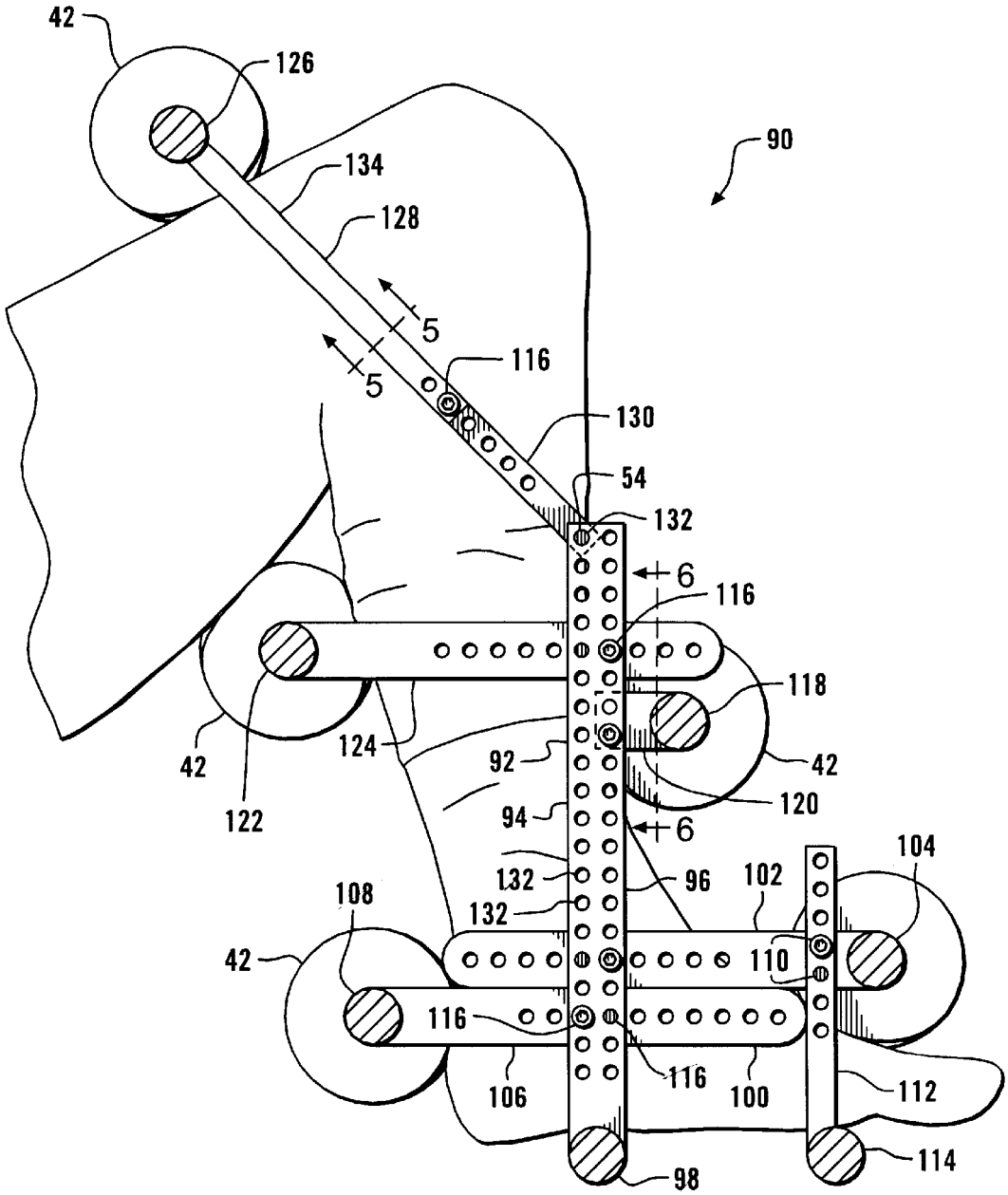
FIG. 4 is a side elevational view of an alternative embodiment leg barbell of this invention.
Figure 5:
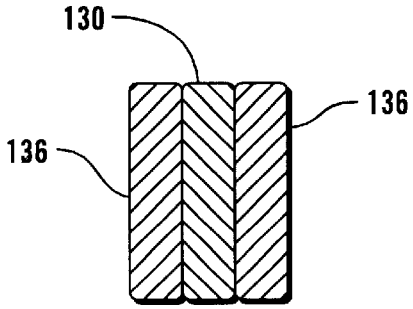
FIG. 5 is a cross-sectional view of the leg barbell of FIG. 4, taken along section line 5—5.
Figure 6:
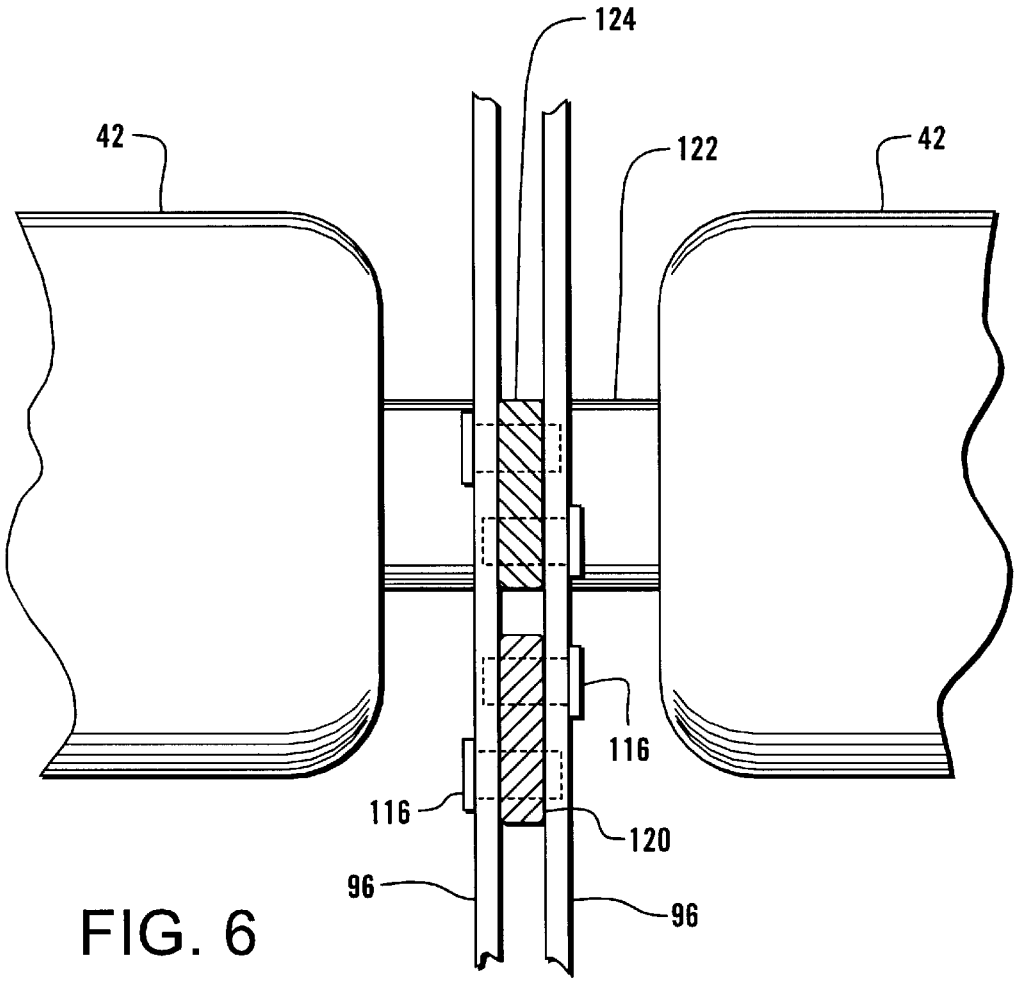
FIG. 6 is a cross-sectional view of the leg barbell of FIG. 4 taken along section line 6—6.

It should be noted that the leg barbell of this invention may be assembled using a wide variety of adjustable connections and subassemblies. For example, an alternative embodiment leg barbell 90, as shown in FIGS. 4–6, rather than having telescoping tubes, has an arrangement of perforated barstock members which are connected with threaded fasteners. As shown in HG. 4, the leg barbell 90 has a frame 92 composed of perforated barstock members. The frame 92 has a generally upwardly extending leg column 94 defined by two parallel perforated steel straps 96 which are welded to a rear foot rod 98. Each strap has two columns of clearance holes 132 dimensioned to allow clearance for ¼ inch bolt. The frame 92 has a foot column 100 defined by a rearwardly extending front weight rod mounting member 102 which is fixed to a front weight rod 104; and a mounting member 106 which extends frontwardly from a rear weight rod 108. Each of the mounting members 102, 106 has a row of tapped ¼-20 holes. The two mounting members 102,106 are generally identical approximately ¼ inch thick barstock elements. However the front weight rod mounting member 102 also has two front tapped holes 110 to which an upwardly extending mounting member 112 is connected. The mounting member 112 is composed of two parallel straps which extend upwardly from a front foot rod 114.

The mounting members 102, 106 are one-quarter inch thick and extend between the two straps 96 of the leg column 94. Each mounting member is fastened to the straps 96 by two fasteners 116 extending inwardly from opposite sides through one or the other of the clearance holes in the two adjacent straps. The fasteners may be, for example, a bolt or a roundhead cap screw. As shown in FIG. 6, each fastener 116 extends through a clearance hole into the tapped piece between the two straps. The fastener 116 extends through the tapped piece into the opposite clearance hole, and thereby prevents the straps from twisting with respect to one another. In this way, each fastener can be installed with only a single wrench. Furthermore, because the heads of the fasteners are on opposite sites, the wrench does not need to contend with another bolt head when tightening one of the fasteners, this permits a more compact design. Although not shown in FIG. 6, a lock washer may be provided between the fastener head and the strap through which it extends.

The upper weight rod 118 has a short rearwardly extending mounting member 120 also connected by two fasteners 116 between the straps 96 of the leg column 94. The barbell 90 may have only the weight rods and foot rods discussed with respect to the leg barbell 20 above, or, as shown in FIG. 4, it may be optionally supplied with a calf support rod 122 positioned rearwardly of the leg column on a mounting member 124, similar to the mounting member 106. In addition, a thigh support rod 126 is pivotably connected to the top of the leg column 94 by a two-part support member 128 composed of a first member 130 which is a single ¼ inch thick perforated steel barstock element which is connected by a restraint pin 54 to the upper clearance holes 132 in the straps of the leg column. This pin connection permits the first member to pivot with respect to the leg column. The support member 128 further has a second member 134 which, as shown in FIG. 5, has two straps 136 which are connected to the first member 130 to achieve the desired total length. Each fastener 116 may be a screw with a button alien head. The fasteners extend through the clearance holes, into the attached tapped hole of an adjacent member, and may protrude into the clearance hole on the other side.

The leg barbells of this invention may be used to perform a variety of exercises to develop various muscles or muscle groups, for example in exercising the joints and the abs. The barbell may be used in performing a leg curl, which exercises the hamstrings at the back of the legs. This exercise may be performed while lying on the stomach, with or without the use of a bench, or with a large exercise ball. A leg extension, in which the knee is extended works the upper thigh. Used in performing an abdominal crunch exercise, the abdominal muscles are exercised. Used in a leg press, the buttocks, hips and back are exercised. In a calf extension, the calves and the fronts of the lower leg are exercised. The leg curl, leg extensions, and the abdominal crunch may be performed from a position seated on a platform. The leg press, leg extension, abs, and calf extension exercises may be performed while lying on the ground. In most exercises, as shown in FIG. 2, the user's feet are inserted within the leg barbell above the front and rear foot rods, and between the front and rear weight rods. In the calf extension exercise, the user's toes may be positioned above the rear foot rod, with the feet under the rear weight rod of the barbell engaged against the user's ankles and the top portion of the feet. Although primarily for leg exercises, the barbell may be grasped in a user's hands and used to perform arm exercises such as an arm curl and an arm pull. In these exercises the user may grasp the upper weight rod, either interior to the weights or exterior to the weights. Foam covers 42 may be positioned on each of the weight rods.

It will be noted that the leg barbell 20 or 90 of this invention is symmetrical about the leg column such that the loaded barbell is balanced when engaged by a user. Hence, the weight rods and foot rods each extend sidewardly from the leg column and foot column approximately the same distance on either side.

Although the front weight rod, the rear foot rod, and the upper weight rod are sufficient to retain the barbell on the user on basic exercises, for a wider variety of exercises, the front foot rod and the rear weight rod are desirable. It should be noted that where cylindrical rods are illustrated or claimed, the rods could also be square, rectangular or other shape in section.

It is understood that the invention is not limited to the particular construction and arrangement of parts herein illustrated and described, but embraces such modified forms thereof as come within the scope of the following claims.

I claim:

1. A leg barbell comprising:

a leg column extending generally upwardly;

a foot column connected to the leg column, and extending in a front to back direction, wherein the leg column and the foot column comprise a frame;

a front rod connected to the foot column;

a rear rod positioned rearward of the front rod and connected to the foot column;

a front foot rod connected to the foot column and extending beneath the foot column;

a rear foot rod connected to frame and extending beneath the foot column and spaced rearwardly from the front foot rod; and an upper rod connected to the leg column above the front rod and the rear rod, wherein the front rod, the rear rod, the upper rod, the front foot rod, and the rear foot rod are approximately parallel to one another, and are spaced from one another such that a user's feet may be inserted between the front rod and the rear rod above the front foot rod and rear foot rod, with one foot on either side of the leg column.

2. The leg barbell of claim 1 further comprising:

at least one resilient cushion mounted to the front rod; and at least one resilient cushion mounted to the rear rod.

3. The leg barbell of claim 1 further comprising at least one resilient cushion mounted to the upper rod.

4. The leg barbell of claim 1 further comprising at least one removable weight connected to one of the front rod, the rear rod, and the upper rod.

5. The leg barbell of claim 1, further comprising:

a rear mounting member extending frontwardly from the rear rod; and a front mounting member extending rearwardly from the front rod, the rear mounting member and the front mounting member having portions which engage with the leg column in a plurality of positions to thereby adjust the distance between the front rod and the rear rod.

6. The leg barbell of claim 5 wherein one of the rear mounting member and the front mounting member is received in a telescoping fashion with the other.

7. The leg barbell of claim 6 wherein portions of the leg column define a central connector having a lower sleeve through which the front mounting member and the rear mounting member extend, and wherein an upper mounting member extends downwardly from the upper rod into the central connector in telescoping relation, and wherein the rear foot rod is fixed to an upwardly extending sleeve which receives the central connector therein.

8. A leg barbell comprising:

a leg column extending generally upwardly;

a foot column connected to the leg column, and extending in a front to back direction, the leg column and the foot column comprising a frame;

a front rod connected to the foot column;

a rear foot rod connected to the frame and extending beneath the foot column and spaced rearwardly from the front rod; and an upper rod connected to the leg column above the front rod and the rear foot rod, wherein the front rod, the upper rod, and the rear foot rod are approximately parallel to one another and each extend sidewardly from the leg column, and are spaced from one another such that a user's feet may be inserted between the front rod and the rear foot rod, with one Coot on either side of the leg column.

9. The leg barbell of claim 8 further comprising at least one removable weight connected to one of the front rod, and the upper rod.

10. The leg barbell of claim 8, further comprising:

a rear rod connected to the frame and positioned rearwardly of the rear foot rod;

a rear mounting member extending frontwardly from the rear rod; and a front mounting member extending rearwardly from the front rod, the rear mounting member and the front mounting member having portions which engage with the leg column in a plurality of positions to thereby adjust the distance between the front rod and the rear rod.

11. The leg barbell of claim 10 wherein one of the rear mounting member and the front mounting member is received in a telescoping fashion with the other.

12. The leg barbell of claim 11 wherein portions of the leg column define a central connector having a lower sleeve through which the front mounting member and the rear mounting member extend, and wherein an upper mounting member extends downwardly from the upper rod into the central connector in telescoping relation, and wherein the rear foot rod is fixed to an upwardly extending sleeve which receives the central connector therein.

13. A leg barbell for engagement on two side-by-side feet of a user, the leg barbell comprising:

a frame having a first member extending in a first direction from the feet up toward knees of the user, and a second member connected to the first member, and extending in a second direction extending between toes and heels of the user;

a front rod connected to the frame and extending to a first side of the frame to engage a first foot of the user, and also extending on a second side of the frame to engage a second foot of the user;

a rear foot rod connected to the frame and extending beneath and spaced rearwardly from the front rod, the rear foot rod extending from the first side of the frame to engage the first foot, and also extending on the second side of the frame to engage a second foot;

an upper rod connected to the frame above the front rod and the rear foot rod, wherein the front rod, the upper rod, and the rear foot rod are approximately parallel to one another and each extend sidewardly from the first member, and are spaced from one another such that a user's feet may be inserted between the front rod and the rear foot rod, with one Loot on either side of the first member; and at least one removable weight connected to one of the front rod, and the upper rod.

14. A leg barbell for engagement on two side-by-side feet of a user, the leg barbell comprising:

a frame having a first member extending in a first direction from the feet up toward knees of the user, and a second member connected to the first member, and extending in a second direction extending between toes and heels of the user;

a front rod connected to the frame and extending to a first side of the frame to engage a first foot of the user, and also extending on a second side of the frame to engage a second foot of the user;

a rear foot rod connected to the frame and extending beneath and spaced rearwardly from the front rod, the rear foot rod extending from the first side of the frame to engage the first foot, and also extending on the second side of the frame to engage a second foot; and an upper rod connected to the frame above the front rod and the rear foot rod, wherein the front rod, the upper rod, and the rear foot rod are approximately parallel to one another and each extend sidewardly from the first member, and are spaced from one another such tat a user's feet may be inserted between the front rod and the rear foot rod, with one foot on either side of the first member;

a rear rod connected to the frame and positioned rearwardly of the rear foot rod;

a rear mounting member extending frontwardly from the rear rod; and a front mounting member extending rearwardly from the front rod, the rear mounting member and the front mounting member having portions which engage with the first member in a plurality of positions to thereby adjust the distance between the front rod and the rear rod.

15. The leg barbell of claim 14 wherein one of the rear mounting member and the front mounting member is received in a telescoping fashion with the other.

16. The leg barbell of claim 15 wherein portions of the first member define a central connector having a lower sleeve through which the front mounting member and the rear mounting member extend, and wherein an upper mounting member extends downwardly from the upper rod into the central connector in telescoping relation, and wherein the rear foot rod is fixed to an upwardly extending sleeve which receives the central connector therein.

* * * * *

UNITED STATES PATENT AND TRADEMARK OFFICE

CERTIFICATE OF CORRECTION

PATENT NO. : 6,592,497 B2
APPLICATION NO. : 09/793208
DATED : July 15, 2003
INVENTOR(S) : Jeffrey C. Greenheck It is certified that error appears in the above-identified patent and that said Letters Patent is hereby corrected as shown below:

In column 3, line 30 of the issued patent, “2%” should be -- 22. --.

In column 4, line 20 of the issued patent, “pin bole” should be -- pin hole --.

In column 4, line 53 of the issued patent, “or” should be -- of --.

In column 5, line 18 of the issued patent, “cain” should be -- cam --.

In column 5, line 23 of the issued patent, “trough” should be -- through --.

In column 5, line 26 of the issued patent, “cain” should be -- cam --.

In column 5, line 39 of the issued patent, “HG. 4” should be -- FIG. 4 --.

In column 6, line 27 of the issued patent, “alien” should be -- allen --.

In column 8, line 7 of the issued patent, “coot” should be -- foot --.

In column 8, line 58 of the issued patent, “loot” should be -- foot --.

In column 9, line 16 of the issued patent, “tat” should be -- that --.

Signed and Sealed this

Thirtieth Day of January, 2007

JON W. DUDAS
*Director of the United States Patent and Trademark Office*